US011052664B2

(12) United States Patent
Miyasaka

(10) Patent No.: US 11,052,664 B2
(45) Date of Patent: Jul. 6, 2021

(54) LIQUID ABSORBING DEVICE, CONTROL METHOD FOR LIQUID ABSORBING DEVICE, AND LIQUID ABSORBING MATERIAL

(71) Applicant: SEIKO EPSON CORPORATION, Tokyo (JP)

(72) Inventor: Yoichi Miyasaka, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/697,331

(22) Filed: Nov. 27, 2019

(65) Prior Publication Data

US 2020/0164653 A1 May 28, 2020

(30) Foreign Application Priority Data

Nov. 28, 2018 (JP) ..... JP2018-222222

(51) Int. Cl.
*B41J 2/17* (2006.01)
*B41J 2/165* (2006.01)

(52) U.S. Cl.
CPC ..... *B41J 2/1721* (2013.01); *B41J 2/16523* (2013.01)

(58) Field of Classification Search
CPC ..... B41J 2/1721; B41J 2/16523
See application file for complete search history.

(56) References Cited

U.S. PATENT DOCUMENTS

| | | | |
|---|---|---|---|
| 9,039,135 | B2 | 5/2015 | Kaneko |
| 9,139,012 | B2 | 9/2015 | Yamada et al. |
| 9,555,634 | B2 | 1/2017 | Matsumoto et al. |
| 10,858,212 | B2 | 12/2020 | Muhamad Nor Salehuddin et al. |
| 2013/0106968 | A1 | 5/2013 | Matsumoto et al. |
| 2014/0183125 | A1 | 7/2014 | Yamagami et al. |
| 2015/0109377 | A1 | 4/2015 | Yamada et al. |
| 2015/0165778 | A1 | 6/2015 | Matsumoto et al. |
| 2015/0336386 | A1* | 11/2015 | Shimazu ..... B41J 2/1721 347/30 |
| 2017/0120597 | A1* | 5/2017 | Nishikawa ..... B41J 2/16508 |
| 2017/0151802 | A1 | 6/2017 | Toba et al. |
| 2018/0296403 | A1 | 10/2018 | Kobayashi et al. |
| 2018/0312362 | A1 | 11/2018 | Muhamad Nor Salehuddin et al. |

FOREIGN PATENT DOCUMENTS

| | | | |
|---|---|---|---|
| CN | 103895354 | A | 7/2014 |
| CN | 104553334 | A | 4/2015 |
| CN | 106985538 | A | 7/2017 |
| CN | 108024885 | A | 5/2018 |
| JP | 2014-040045 | A | 3/2014 |
| TW | 201318880 | A | 5/2013 |

* cited by examiner

*Primary Examiner* — Julian D Huffman
(74) *Attorney, Agent, or Firm* — Oliff PLC

(57) ABSTRACT

A liquid absorbing device includes: a liquid absorber containing fibers and an anionic absorbent resin designed to absorb a liquid; a container having a feed port to which the liquid is supplied, a storage section that is connected with the feed port and that stores the liquid absorber, an inflow section configured such that part of the liquid flows into when the liquid is supplied to the storage section, and a communicating portion that connects the storage section with the inflow section; and a detection unit that is provided in the inflow section and that is configured to detect a surface of the liquid in the inflow section.

8 Claims, 8 Drawing Sheets

LIQUID ABSORBING DEVICE, CONTROL METHOD FOR LIQUID ABSORBING DEVICE, AND LIQUID ABSORBING MATERIAL

The present application is based on, and claims priority from JP Application Serial Number 2018-222222, filed Nov. 28, 2018, the disclosure of which is hereby incorporated by reference herein in its entirety.

BACKGROUND

1. Technical Field

The present disclosure relates to a liquid absorbing device, a control method for the liquid absorbing device, and a liquid absorbing material.

2. Related Art

In an ink jet printer, waste ink is typically generated, for example, during head cleaning that is performed to prevent deterioration in printing quality due to clogging with ink or during ink filling after an exchange of ink cartridges. For this reason, an ink jet printer includes a liquid absorber for absorbing waste ink to prevent unintended attachment of such waste ink to internal mechanisms or the like of the printer.

For example, JP-A-2014-040045 discloses a waste ink storage structure including: a storage space for storing waste ink; a waste ink introduction section for introducing waste ink into the storage space; a ventilation hole for connecting the storage space to the outside; and two layers of an ink absorbing material that are filled in the storage space and absorb waste ink through permeation. As the ink absorbing material, a liquid absorber including cellulose fibers, a heat-fusible substance, and a fireproofing substance is disclosed. Moreover, it is also disclosed that the ink absorbing material is used particularly for absorbing pigment ink, in which pigment particles are dispersed.

Meanwhile, either pigment ink or dye ink is assigned to a given ink jet printer as a usable type of ink. For example, the ink absorbing material described in JP-A-2014-040045 is primarily used for absorbing pigment ink. When dye ink is mistakenly used, there is thus a risk of impairing output image quality, causing clogging of a head, or the like. Accordingly, there is a need for a means that can detect what type of liquid is used for liquids having different electrolyte concentrations, such as pigment ink and dye ink.

SUMMARY

The present disclosure was accomplished to meet at least part of the above-mentioned need and can be realized as follows.

The liquid absorbing device of the present disclosure is characterized by including a liquid absorber containing fibers and an absorbent resin designed to absorb a liquid; a container having a feed port to which the liquid is supplied, a storage section that is connected with the feed port and that stores the liquid absorber, an inflow section configured such that part of the liquid flows into when the liquid is supplied to the storage section, and a communicating portion that connects the storage section with the inflow section; and a detection unit that is provided in the inflow section and that is configured to detect a surface of the liquid in the inflow section.

A control method for the liquid absorbing device of the present disclosure is characterized by including acquiring data about frequency or time when a height of the surface of the liquid detected by the detection unit exceeds a reference value; and determining a type of the liquid based on the data.

DESCRIPTION OF EXEMPLARY EMBODIMENTS

Hereinafter, a liquid absorbing device, a control method for the liquid absorbing device, and a liquid absorbing material of the present disclosure will be described in detail based on preferred embodiments illustrated in the attached drawings.

First Embodiment

Figure 1:
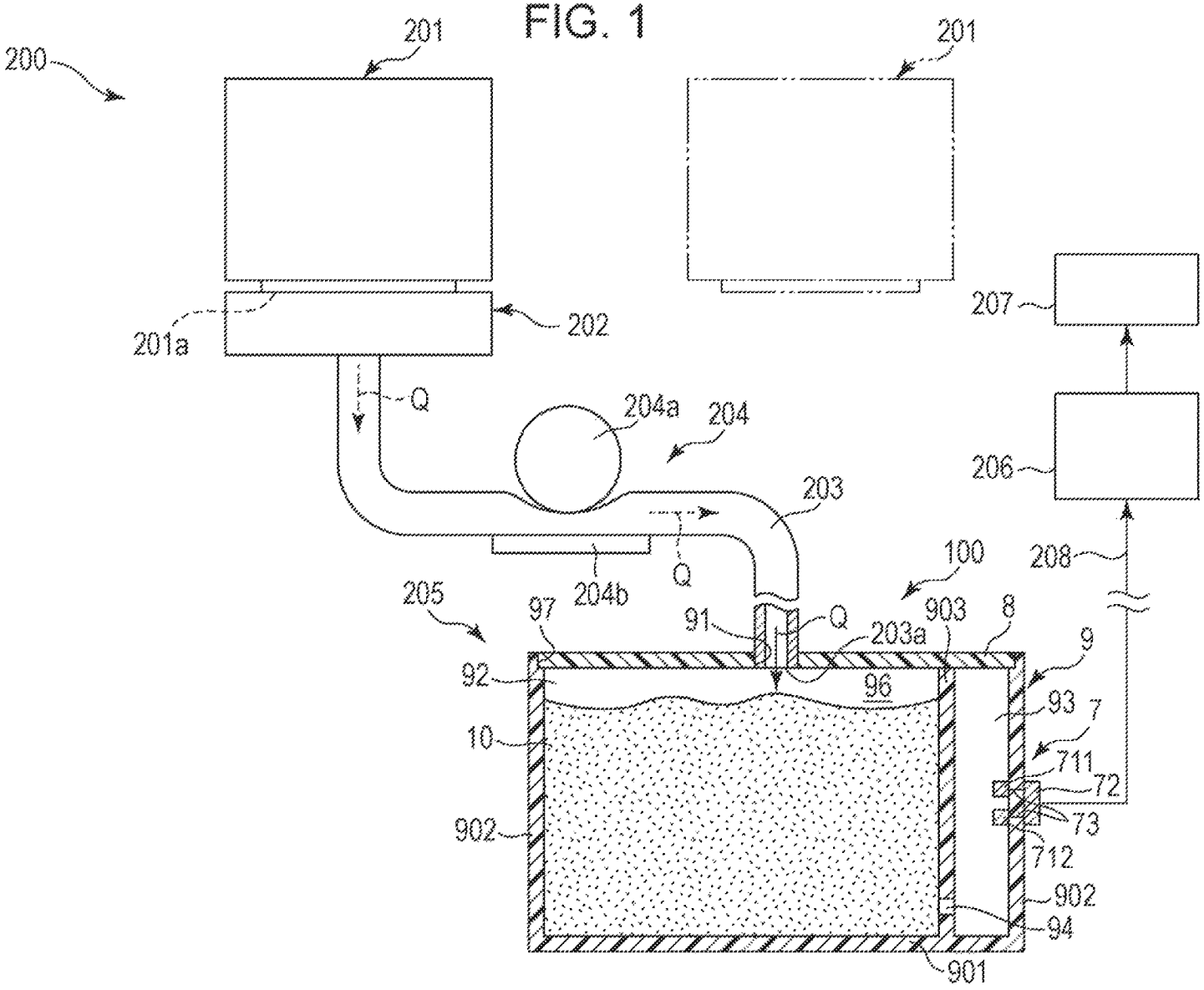
FIG. 1 is a partial vertical cross-sectional view illustrating a liquid absorbing device according to a first embodiment.
Figure 2:
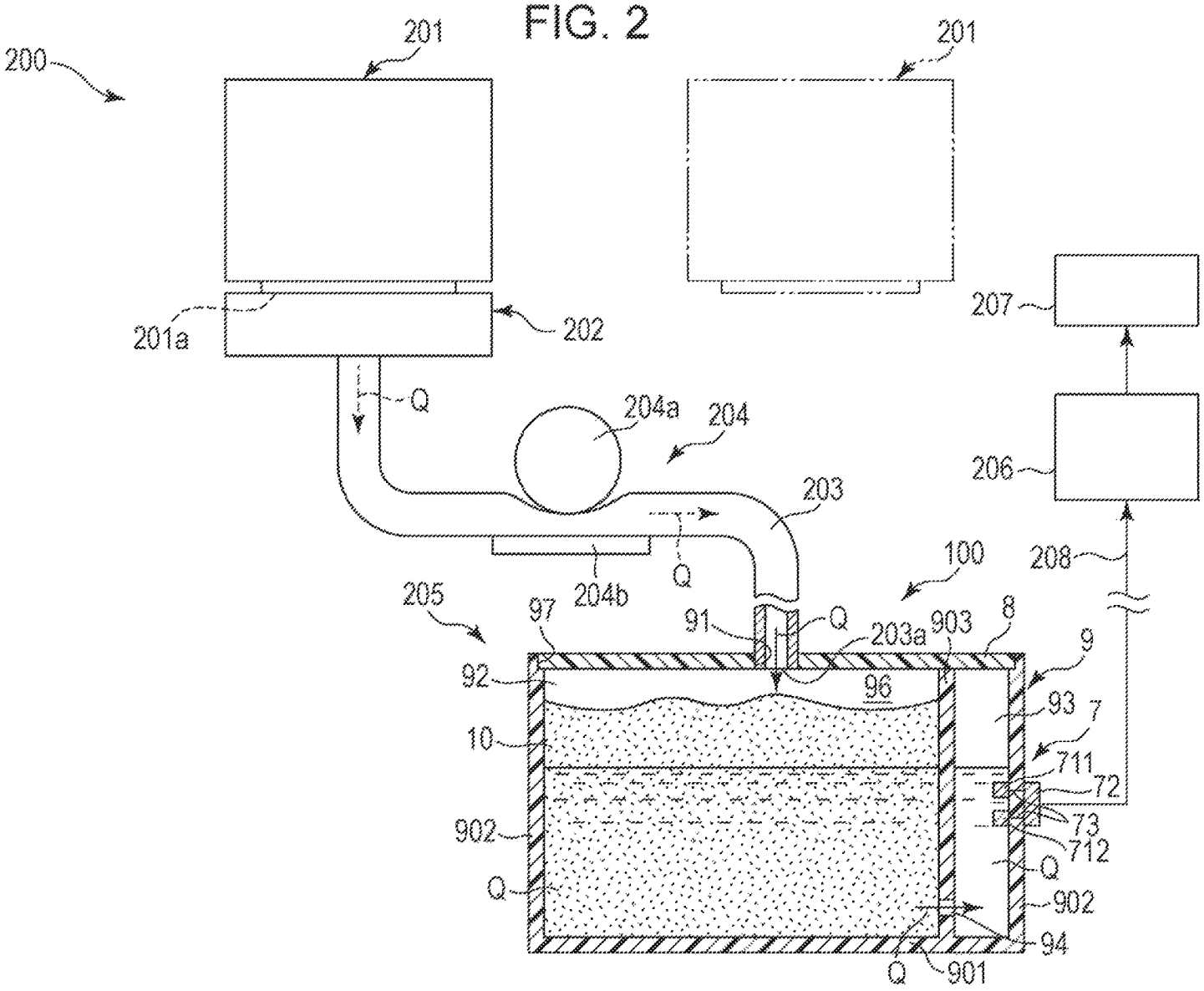
FIG. 2 is a partial vertical cross-sectional view illustrating the liquid absorbing device according to the first embodiment in use.
Figure 3:
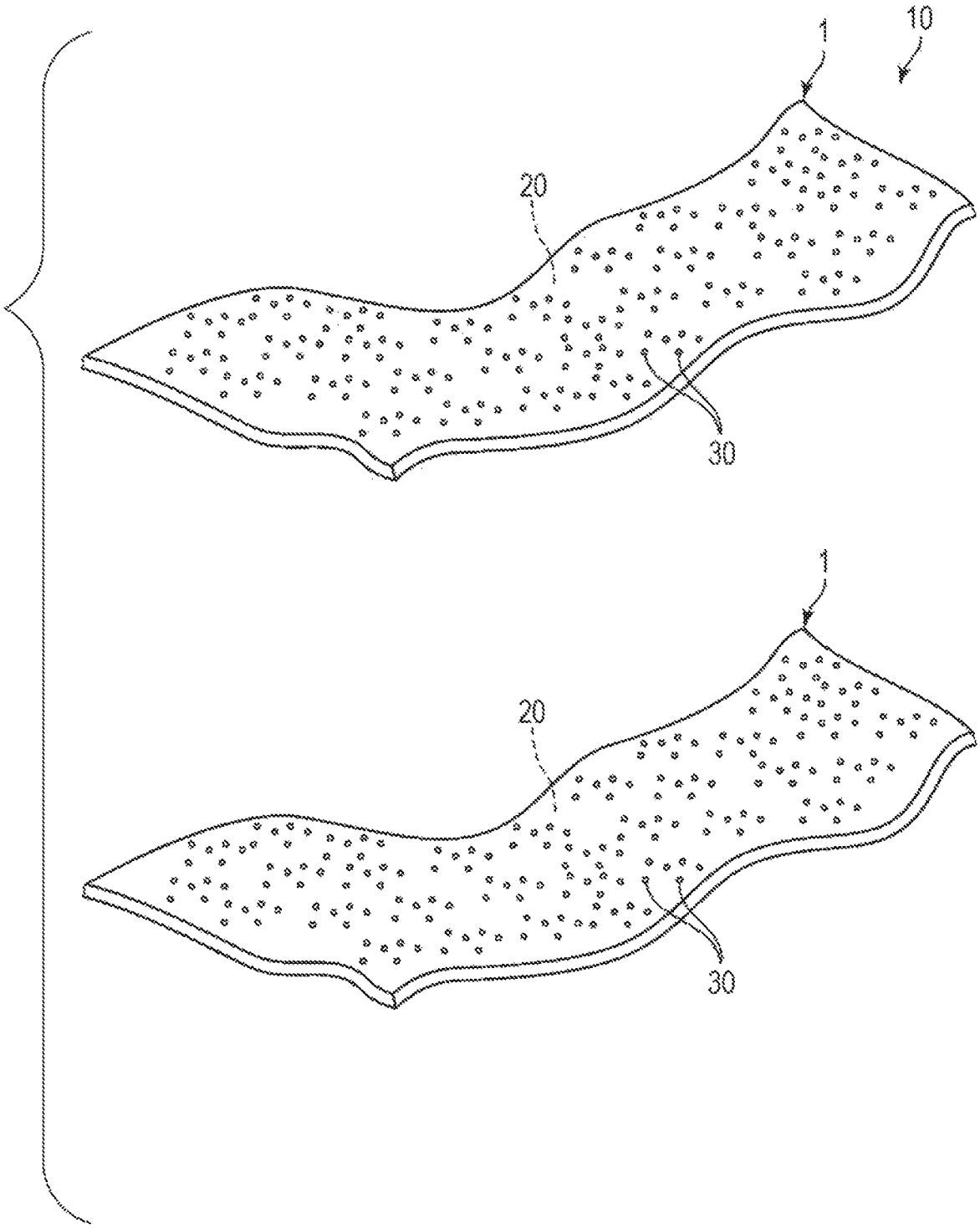
FIG. 3 is a perspective view illustrating small pieces as an exemplary form of a liquid absorber included in the liquid absorbing device of FIGS. 1 and 2.
Figure 4:
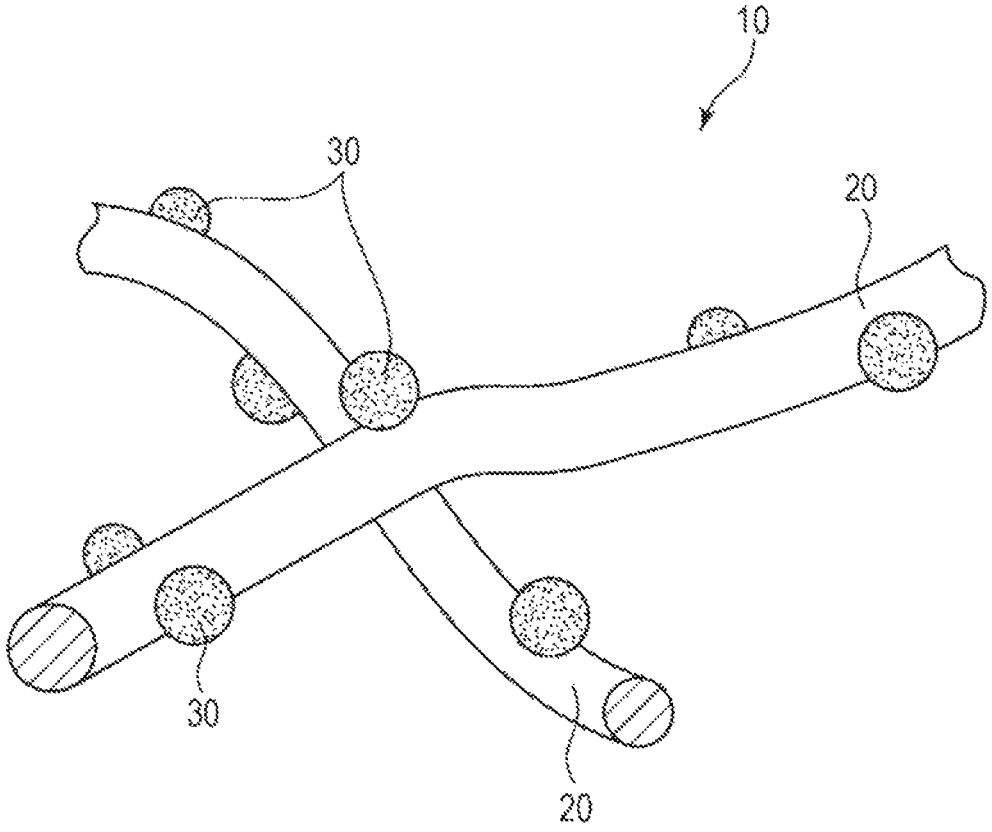
FIG. 4 is a perspective view illustrating disintegrated fibers as another exemplary form of the liquid absorber included in the liquid absorbing device of FIGS. 1 and 2.

First, a liquid absorbing device according to the first embodiment will be described. FIG. 1 is a partial vertical cross-sectional view illustrating the liquid absorbing device according to the first embodiment. FIG. 2 is a partial vertical cross-sectional view illustrating the liquid absorbing device according to the first embodiment in use. FIG. 3 is a perspective view illustrating small pieces as an exemplary form of a liquid absorber included in the liquid absorbing device of FIGS. 1 and 2. FIG. 4 is a perspective view illustrating disintegrated fibers as another exemplary form of the liquid absorber included in the liquid absorbing device of FIGS. 1 and 2. In the description hereinafter, the upper side and lower side in FIG. 1 will be mentioned as the upper side and lower side in the vertical direction, respectively.

A droplet discharge apparatus 200 illustrated in FIG. 1 is, for example, an ink jet color printer that uses pigment ink as ink Q. The droplet discharge apparatus 200 includes: an ink discharge head 201 for discharging ink Q; a capping unit 202 for preventing clogging of nozzles 201*a* of the ink discharge head 201; a tube 203 for coupling the capping unit 202 to a liquid absorbing device 100; a roller pump 204 for sending ink Q from the capping unit 202 to the liquid absorbing device 100; and a collecting unit 205.

In addition, the droplet discharge apparatus 200 also includes: a control unit 206 for controlling operation at each section; and a notifying unit 207 for issuing notices, warnings, and the like based on signals from the control unit 206.

The ink discharge head 201 has a plurality of nozzles 201*a* that discharge ink Q downward. The ink discharge head 201 can perform printing by discharging ink Q while moving relative to recording media, such as paper.

The capping unit 202 prevents clogging of the nozzles 201*a* by collectively sucking ink in the respective nozzles 201*a* through the operation of the roller pump 204 when the ink discharge head 201 is placed at the standby position.

The tube 203 is a tubular channel for guiding ink Q sucked through the capping unit 202 to the liquid absorbing device 100. The tube 203 is flexible.

The roller pump 204 is arranged in the intermediate portion of the tube 203 and includes a roller section 204*a* and a nip portion 204*b* for pinching the intermediate portion of the tube 203 with the roller section 204*a*. Sucking force is generated at the capping unit 202 through the tube 203 by rotating the roller section 204*a*. Moreover, by continuing the rotation of the roller section 204*a*, ink Q attached to the nozzles 201*a* can be sent out to the collecting unit 205.

The collecting unit 205 collects ink Q sent out by the roller pump 204. In the present embodiment, the liquid absorbing device 100 is used as the collecting unit 205. Ink Q is absorbed as waste ink by the liquid absorbing device 100.

The liquid absorbing device 100 includes: a liquid absorber 10 containing fibers 20 illustrated in FIG. 3 or 4 and an anionic absorbent resin 30 that is illustrated in FIG. 3 or 4 and that can absorb ink Q as an exemplary liquid; and a container 9 illustrated in FIGS. 1 and 2 for storing the liquid absorber 10. The container 9 includes: a feed port 91 to which ink Q is supplied; a storage section 92 that is connected with the feed port 91 and that stores the liquid absorber 10; an inflow section 93 into which part of ink Q can flow when ink Q is supplied to the storage section 92; and a communicating portion 94 that connects the storage section 92 with the inflow section 93. Moreover, the liquid absorbing device 100 further includes a detection unit 7 that is provided in the inflow section 93 and that can detect the liquid surface of ink Q in the inflow section 93.

The liquid absorber 10 includes the anionic absorbent resin 30 illustrated in FIG. 3 or 4. The anionic absorbent resin 30 is a resin that generates anionic groups through dissociation of hydrophilic groups upon absorption of moisture in a liquid. In this anionic absorbent resin 30, polymer long chains closely intertwine with each other under dry conditions but start to spread upon absorption of moisture in the liquid such that the hydrophilic groups are dissolved in water. Consequently, it is possible to absorb much liquid.

Meanwhile, the anionic absorbent resin 30 exhibits different absorption characteristics depending on whether a solute contained in a liquid is an electrolyte or a nonelectrolyte. For example, when a solute contained in a liquid is a nonelectrolyte, the amount of absorbed liquid is relatively large regardless of the concentration of the nonelectrolyte. Accordingly, the anionic absorbent resin 30 exhibits good absorption characteristics to a liquid containing a nonelectrolyte regardless of the concentration of the nonelectrolyte. For this reason, the liquid absorbing device 100 can collect and store a sufficient amount of ink Q. As a result, it is possible to collect and store regularly generated waste ink over a long period of time and thus operate a droplet discharge apparatus 200 in a stable manner.

In contrast, when a liquid contains an electrolyte, the anionic absorbent resin 30 tends to decrease the amount of absorbed liquid as the concentration of the electrolyte increases. Accordingly, the anionic absorbent resin 30 cannot absorb a sufficient amount of a liquid containing an electrolyte.

As described above, the anionic absorbent resin 30 is a resin that exhibits different absorption characteristics when liquids to be absorbed have different electrolyte concentrations. Here, exemplary liquids containing nonelectrolytes as solutes include pigment ink, whereas exemplary liquids containing electrolytes as solutes include dye ink.

By taking account of such absorption characteristics of the anionic absorbent resin 30, the liquid absorbing device 100 according to the present embodiment includes, as in the foregoing, the container 9 having: the storage section 92 in which the liquid absorber 10 containing the anionic absorbent resin 30 is stored; and the inflow section 93 connected with the storage section 92 into which part of ink Q that has not been absorbed in the storage section 92 can flow. In the liquid absorbing device 100 illustrated in FIGS. 1 and 2, the majority of the space in the storage section 92 is filled with the liquid absorber 10 whereas the inflow section 93 is hollow. These storage section 92 and inflow section 93 are connected through the communicating portion 94.

When ink Q is supplied from the feed port 91 that is connected with the storage section 92, ink Q first comes into contact with the liquid absorber 10 stored in the storage section 92. The droplet discharge apparatus 200 according to the present embodiment presumes the use of pigment ink. Accordingly, when ink Q is pigment ink, ink Q is absorbed well by the liquid absorber 10. As a result, the liquid absorbing device 100 functions well as the collecting unit 205.

Moreover, since pigment ink is absorbed by the liquid absorber 10, the pigment ink does not flow into the inflow section 93. However, when a large amount of pigment ink is supplied, some of the ink also flows into the inflow section 93 in some cases. Even in such a case, since the ink is absorbed by the liquid absorber 10 over time, the liquid surface of the pigment ink in the inflow section 93 rapidly goes down. Further, it may be designed to measure the amount of ink Q discharged from the ink discharge head 201 of the droplet discharge apparatus 200 and terminate the discharge of ink Q before the liquid absorber 10 reaches the absorption limit.

Here, a function of monitoring the liquid surface of ink Q is imparted to the inflow section 93. Specifically, as described above, the inflow section 93 is provided with the detection unit 7 that can detect the liquid surface of ink Q in the inflow section 93. When pigment ink is used as ink Q, the liquid surface rarely rises to the height at which the detection unit 7 is provided since the amount of the pigment ink that flows into the inflow section 93 is small. Consequently, the frequency and time when the detection unit 7 detects the liquid surface of ink Q are zero or extremely limited. Based on such detection results of the liquid surface by the detection unit 7, it is possible to detect that pigment ink is used as ink Q.

Now, a case in which dye ink is used as ink Q will be described. Dye ink is an ink that is not presumed to be used in the droplet discharge apparatus 200. When dye ink is mistakenly used, there is a risk of impairing output image quality or causing clogging of the ink discharge head 201. For this reason, if dye ink is used, it is required to detect such use rapidly and take measures therefor.

When dye ink is used as ink Q, too, the dye ink first comes into contact with the liquid absorber 10 stored in the storage section 92. As described above, however, the anionic absorbent resin 30 included in the liquid absorber 10 lacks satisfactory absorption characteristics for dye ink, which is an electrolyte solution. Consequently, the dye ink permeates into the liquid absorber 10 but accumulates at the bottom of the storage section 92 due to the small absorbed amount. Subsequently, when the liquid surface of the dye ink reaches the height of the communicating portion 94, the dye ink flows into the inflow section 93 through the communicating portion 94. The liquid surface of the dye ink that has flown into the inflow section 93 gradually rises corresponding to the amount of the dye ink supplied to the storage section 92 from the feed port 91. Finally, when the height of the liquid surface of the dye ink in the inflow section 93 reaches the detection unit 7, the presence of the liquid surface is detected by the detection unit 7. In this case, the frequency and/or time when the detection unit 7 detects the liquid surface increase relative to a case in which pigment ink is used. In other words, since dye ink is less likely to be absorbed by the liquid absorber 10, the liquid surface remains high and is thus kept at the height of the detection unit 7 more frequently or for a long time after the dye ink flows into the inflow section 93. For this reason, based on such detection results, it is possible to detect that dye ink is used. On such an occasion, as described hereinafter, the droplet discharge apparatus 200 may cause the notifying unit 207 to issue a warning about the use of dye ink or cause the control unit 206 to terminate the discharge of dye ink at the ink discharge head 201. Consequently, it is possible to prevent damage to the droplet discharge apparatus 200 or the overflow of dye ink from the liquid absorbing device 100.

Even when pigment ink is used, the frequency and/or time when the detection unit 7 detects the liquid surface may increase in a similar manner to the foregoing. In such a case, a fact that the liquid absorber 10 cannot absorb pigment ink satisfactorily is indirectly detected. In other words, functional failure of the liquid absorber 10 is suspected since a large amount of pigment ink flows into the inflow section 93 despite the use of pigment ink. In this case, too, the droplet discharge apparatus 200 may control the operation at the ink discharge head 201 to terminate the discharge of pigment ink. Consequently, the overflow of pigment ink from the liquid absorbing device 100 can be prevented.

As in the foregoing, according to the liquid absorbing device 100 of the present embodiment, it is possible to absorb pigment ink as an exemplary liquid and, at the same time, easily detect what type of ink is used for liquids with different electrolyte concentrations, specifically pigment ink and dye ink, for example.

The liquid absorbing device 100 is detachably fitted to the droplet discharge apparatus 200 and is used in the fitted state for absorbing ink Q as described above. Accordingly, when the liquid absorber 10 is determined to have reached the absorption limit according to the amount of ink Q discharged from the ink discharge head 201, the liquid absorber 10 may be replaced with a new liquid absorber 10. When the liquid absorber 10 is determined to have reached the absorption limit, replacement of the liquid absorber 10 may be recommended by notification through the notifying unit 207 or the like.

The liquid absorber 10 contains the fibers 20 and the anionic absorbent resin 30, as described above. When ink Q is supplied to the liquid absorber 10, the fibers 20 act to retain ink Q temporarily and then send it to the anionic absorbent resin 30. Since the fibers 20 act as a buffer through this procedure, it is possible to enhance absorption characteristics of ink Q by the liquid absorber 10 as a whole.

Examples of the fibers 20 include synthetic resin fibers, such as polyester fibers and polyamide fibers; natural resin fibers, such as cellulose fibers, keratin fibers, and fibroin fibers; and chemically modified fibers thereof. These fibers may be used alone or as an appropriate blend, and are preferably and primarily cellulose fibers and more preferably almost entirely cellulose fibers.

Cellulose is a material with suitable hydrophilicity. Accordingly, when ink Q is applied to the liquid absorber 10, cellulose can suitably take up ink Q, thereby swiftly avoiding a state of particularly high flowability, for example, a state of a viscosity of 10 mPa·s or lower, and suitably send ink Q that has been temporarily taken up to the anionic absorbent resin 30. As a result, the liquid absorber 10 as a whole can achieve particularly excellent liquid absorption characteristics. In addition, cellulose typically has high affinity for the anionic absorbent resin 30 and thus can further suitably support the anionic absorbent resin 30 on the surface of the fibers 20. Moreover, cellulose fibers are renewable natural materials and readily available at low costs among various fibers. For example, cellulose fibers derived from waste paper are relatively inexpensive and contribute to a reduced environmental load. Accordingly, cellulose fibers are also advantageous in view of the reduced production cost, stable production, reduced environmental load, and so forth of the liquid absorber 10.

Cellulose fibers herein mean any fibrous material containing, as a main component, cellulose as a compound, in other words, cellulose in a narrow sense. The cellulose fibers may contain hemicellulose and/or lignin, in addition to cellulose. Moreover, the fibers 20 may be bonded with each other by using a binder, which is not shown.

The average length of the fibers 20 is not particularly limited, but is preferably 0.1 mm or more and 7.0 mm or less, more preferably 0.1 mm or more and 5.0 mm or less, and further preferably 0.2 mm or more and 3.0 mm or less. The average diameter of the fibers 20 is not particularly limited, but is preferably 0.05 mm or more and 2.00 mm or less and more preferably 0.10 mm or more and 1.00 mm or less.

The average aspect ratio of the fibers 20, in other words, a ratio of the average length to the average diameter, is not particularly limited, but is preferably 10 or more and 1,000 or less and more preferably 15 or more and 500 or less.

According to the above-mentioned numerical ranges, it is possible to further suitably support the anionic absorbent resin 30, retain a liquid with the fibers, and/or send out a liquid to the anionic absorbent resin 30. Consequently, small pieces as a whole can achieve further excellent liquid absorption characteristics.

Here, the average length and average diameter of the fibers 20 are the average values of the lengths and diameters for 100 or more of the fibers 20, respectively.

The anionic absorbent resin 30 is not particularly limited and may be any resin having anionic groups upon absorption of water. Examples include carboxymethyl cellulose, polyacrylic acid, polyacrylamide, starch-acrylic acid graft copolymer, hydrolyzed starch-acrylonitrile graft copolymer, vinyl acetate-acrylic ester copolymers, isobutylene-maleic acid copolymer, hydrolyzed acrylonitrile copolymers and acrylamide copolymers, polyethylene oxide, polysulfonic acid compounds, polyglutamic acid, salts or neutralized products thereof, and crosslinked products thereof. Absorbency herein refers to a function of retaining moisture due to hydrophilicity. Many anionic absorbent resins 30 undergo gelation upon absorption of water.

Among these resins, the anionic absorbent resin 30 is preferably a resin having hydrophilic groups in the side chains. Exemplary hydrophilic groups include acid groups, such as carboxyl groups, sulfonic acid groups, phosphate groups, and phosphonic acid groups.

In particular, the anionic absorbent resin 30 is preferably a resin having carboxyl groups in the side chains.

Exemplary carboxyl group-containing units that constitute the anionic absorbent resin 30 include those derived from monomers, such as acrylic acid, methacrylic acid, itaconic acid, maleic acid, crotonic acid, fumaric acid, sorbic acid, cinnamic acid, anhydrides thereof, and salts thereof.

When the anionic absorbent resin 30 having acid groups in the side chains is used, a proportion of the acid groups in the anionic absorbent resin 30 that are neutralized to form salts is preferably 30 mol % or more and 100 mol % or less, more preferably 50 mol % or more and 95 mol % or less, further preferably 60 mol % or more and 90 mol % or less, and the most preferably 70 mol % or more and 80 mol % or less. According to such proportions, further excellent absorption properties of ink Q can be achieved by the anionic absorbent resin 30.

The types of neutralized salts are not particularly limited, and examples include alkali metal salts, such as sodium salts, potassium salts, and lithium salts; and salts of nitrogen-containing bases, such as ammonia. Among these salts, sodium salts are preferable. According to these neutralized salts, further excellent absorption properties of ink Q can be achieved by the anionic absorbent resin 30.

The anionic absorbent resin 30 having acid groups in the side chains is preferable since the absorption rate becomes fast due to electrostatic repulsion that arises between the acid groups during absorption of ink Q. Moreover, when the acid groups are neutralized, ink Q is readily absorbed inside the anionic absorbent resin 30 due to osmotic pressure.

The anionic absorbent resin 30 may have acid group-free constituent units, and exemplary acid group-free constituent units include hydrophilic constituent units, hydrophobic constituent units, and constituent units as polymerizable crosslinkers.

Examples of the hydrophilic constituent units include constituent units derived from nonionic compounds, such as acrylamide, methacrylamide, N-ethyl(meth)acrylamide, N-n-propyl(meth)acrylamide, N-isopropyl(meth)acrylamide, N,N-dimethyl(meth)acrylamide, 2-hydroxyethyl (meth) acrylate, 2-hydroxypropyl (meth)acrylate, polyethylene glycol monomethyl ether (meth)acrylate, polyethylene glycol mono(meth)acrylate, N-vinylpyrrolidone, N-acryloylpiperidine, and N-acryloylpyrrolidine. Herein, (meth)acrylic means acrylic or methacrylic, and a (meth)acrylate means an acrylate or a methacrylate.

Examples of the hydrophobic constituent units include constituent units derived from compounds, such as (meth) acrylonitrile, styrene, vinyl chloride, butadiene, isobutene, ethylene, propylene, stearyl (meth)acrylate, and lauryl (meth)acrylate.

Examples of the constituent units as the polymerizable crosslinkers include constituent units derived from diethylene glycol diacrylate, N,N'-methylenebisacrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylates, diacryloylisocyanurate, tetraallyloxyethane, and diallyloxyacetate salts.

The anionic absorbent resin 30 preferably contains an acrylate salt copolymer or polymerizable crosslinker-crosslinked polyacrylic acid. As a result, there are advantages, such as enhanced absorption properties of ink Q and reduced production costs.

The polymerizable crosslinker-crosslinked polyacrylic acid has a proportion of constituent units having carboxyl groups of preferably 50 mol % or more, more preferably 80 mol % or more, and further preferably 90 mol % or more based on the total constituent units that constitute the molecular chain. When a proportion of the constituent units having carboxyl groups is excessively small, it may be difficult to achieve satisfactorily excellent absorption performance of ink Q.

The carboxyl groups of the polymerizable crosslinker-crosslinked polyacrylic acid are preferably partially neutralized, in other words, form salts through partial neutralization. A proportion of neutralized carboxyl groups in all the carboxyl groups of the polymerizable crosslinker-crosslinked polyacrylic acid is preferably 30 mol % or more and 99 mol % or less, more preferably 50 mol % or more and 99 mol % or less, and further preferably 70 mol % or more and 99 mol % or less.

Moreover, the anionic absorbent resin 30 may have a structure crosslinked with a crosslinker other than the above-described polymerizable crosslinkers.

When the anionic absorbent resin 30 is a resin having acid groups, a compound having a plurality of functional groups that react with acid groups, for example, is preferably used as such a crosslinker.

When the anionic absorbent resin 30 is a resin having functional groups that react with acid groups, a compound having a plurality of acid groups within the molecule may be suitably used as such a crosslinker.

Examples of the compound having a plurality of functional groups that react with acid groups include glycidyl ether compounds, such as ethylene glycol diglycidyl ether, trimethylolpropane triglycidyl ether, (poly)glycerol polyglycidyl ether, diglycerol polyglycidyl ether, and propylene glycol diglycidyl ether; polyhydric alcohols, such as (poly) glycerol, (poly)ethylene glycol, propylene glycol, 1,3-propanediol, polyoxyethylene, triethylene glycol, tetraethylene glycol, diethanolamine, and triethanolamine; and polyamines, such as ethylenediamine, diethylenediamine, polyethylenimine, and hexamethylenediamine. In addition, polyvalent ions, such as zinc, calcium, magnesium, and aluminum, may also suitably be used since these polyvalent ions act as crosslinkers through reactions with the acid groups of the anionic absorbent resin 30.

The anionic absorbent resin 30 may have any shape, such as flake, needle, fibrous, or granular, and is preferably granular. When the anionic absorbent resin 30 is granular, permeability of ink Q can be easily ensured. In addition, the anionic absorbent resin 30 can be suitably supported on the fibers 20. The average particle size of such particles is preferably 10 μm or more and 800 μm or less, more preferably 20 μm or more and 600 μm or less, and further preferably 25 μm or more and 500 μm or less.

Further, the liquid absorber 10 may contain components other than the above-described components. Examples of such components include surfactants; lubricants; antifoaming agents; fillers; antiblocking agents; UV absorbers; colorants, such as pigments and dyes; fireproofing agents; and flow improvers.

The form of the liquid absorber 10 is not particularly limited provided that the above-described fibers 20 and anionic absorbent resin 30 are contained, and exemplary forms include small pieces, sheets, and fluff. In addition, the form may be a so-called sandwich form in which the anionic absorbent resin 30 is sandwiched between sheet fiber substrates containing the fibers 20.

Among these forms, the liquid absorber 10 is particularly preferably a small piece aggregate composed of a plurality of small pieces 1 which are each formed by impregnating a fiber substrate containing the fibers 20 with the anionic absorbent resin 30, as illustrated in FIG. 3. A sheet pulverized by a shredder is an exemplary small piece aggregate. FIG. 3 illustrates two small pieces 1 included in the liquid absorber 10, as an example. A plurality of small pieces 1 contained in the small piece aggregate may have the same configuration as illustrated in FIG. 3 or may have different configurations.

Each of the small pieces 1 illustrated in FIG. 3 is a plate material having two principal surfaces mutually in the front and rear relationship. The small piece 1 is obtained as a cut piece (coarsely crushed piece) by impregnating a fiber substrate of bonded fibers 20 with the anionic absorbent resin 30, followed by cutting (coarse crushing) into small pieces, as necessary. The liquid absorber 10, which is an aggregate of such small pieces 1, can change the shape freely. Accordingly, it is possible to easily store a desirable amount of the liquid absorber 10 in the storage section 92 and at the same time, to easily adjust the bulk density, for example. As a result, it is possible to prevent unevenness in absorption characteristics of ink Q from arising in the liquid absorber 10.

When the small piece 1 is in the above-mentioned sandwich form as well, the small piece 1 is preferably a plate form having two principal surfaces mutually in the front and rear relationship. In such a case, the number of stacked layers of sheet fiber substrates is not particularly limited as long as two layers or more. The two principal surfaces mutually in the front and rear relationship herein refer to the respective surfaces exposed to the outer space of the small piece 1, for example, the front surface (first principal surface) and the rear surface (second principal surface), which is the principal surface on the opposite side, of the small piece 1 illustrated in FIG. 3.

The long axis length of the small piece 1, in other words, the maximum length on the principal surfaces is appropriately set corresponding to the shape, size, and the like of the container 9 and is preferably 0.5 mm or more and 500 mm or less, more preferably 1 mm or more and 100 mm or less, and further preferably 2 mm or more and 30 mm or less, for example.

Moreover, the short axis length of the small piece 1, in other words, the maximum length in the direction orthogonal to the long axis on the principal surfaces is appropriately set corresponding to the shape, size, and the like of the container 9 and is preferably 0.1 mm or more and 100 mm or less, more preferably 0.3 mm or more and 50 mm or less, and further preferably 1 mm or more and 20 mm or less, for example.

Further, the aspect ratio of the long axis and short axis of the small piece 1, in other words, the ratio of the long axis length to the short axis length is preferably 1.0 or more and 200 or less and more preferably 1.0 or more and 30 or less.

Still further, the thickness of the small piece 1 is not particularly limited but is preferably 0.05 mm or more and 2 mm or less and more preferably 0.1 mm or more and 1 mm or less, for example.

Meanwhile, the small pieces 1 preferably satisfy the following three requirements A, B, and C;

A: when the liquid is a low-concentration liquid having an electrolyte concentration of less than 1% by mass at 25° C., a ratio of the mass [g] of the low-concentration liquid absorbed into the anionic absorbent resin 30 to the mass [g] of the anionic absorbent resin 30 is 20 or more and 600 or less, B: when the liquid is a high-concentration liquid having an electrolyte concentration of 1% by mass or more at 25° C., a ratio of the mass [g] of the high-concentration liquid absorbed into the anionic absorbent resin 30 to the mass [g] of the anionic absorbent resin 30 is 10 or more and less than 20, and C: each of the small pieces 1 satisfies relationships of $a^{1/2}/b>5$ and $0.01 \leq b \leq 10.00$ where a is the area [$mm^2$] of one of the two principal surfaces and b is the thickness [mm] in a direction normal to the principal surfaces.

The small pieces 1 that satisfy such three requirements A, B, and C have elongated principal surfaces, and the anionic absorbent resin 30 is a resin that exhibits high absorption characteristics for low-concentration liquids having low electrolyte concentrations whereas low absorption characteristics for high-concentration liquids having high electrolyte concentrations. Accordingly, such small pieces 1 can enhance absorption efficiency of ink Q by successively absorbing with the fibers 20 and the anionic absorbent resin 30 while exploiting the shape as well as allow dye ink to swiftly flow into the inflow section 93 by utilizing clear differences in absorption characteristics between low-concentration liquids and high-concentration liquids. As a result, even when dye ink, in other words, an unintended type of ink Q is used, such use can be quickly detected by the detection unit 7 of the liquid absorbing device 100. Here, the low-concentration liquids are understood as standard liquids having low electrolyte concentrations, such as pigment ink whereas the high-concentration liquids are understood as standard liquids having high electrolyte concentrations, such as dye ink.

The ratio in requirement A is preferably 30 or more and 550 or less and more preferably 50 or more and 500 or less.

The relationships in requirement C are preferably $a^{1/2}/b>7$ and $0.05 \leq b \leq 8.00$.

In the above explanation, an embodiment in which the liquid absorber 10 includes the anionic absorbent resin 30 is described. However, such absorbent resins are not limited to anionic absorbent resins provided that different absorption characteristics are exhibited depending on whether a solute contained in a liquid is an electrolyte or a nonelectrolyte. For example, other absorbent resins may also be used in place of the anionic absorbent resin 30. However, an anionic absorbent resin is preferably used in view of the availability, cost, or the like or in view of the large difference in absorption characteristics.

The above-described small piece aggregate is a liquid absorbing material according to the embodiment. In other words, a liquid absorbing material according to the embodiment is a small piece aggregate composed of a plurality of small pieces 1 which are each formed by impregnating a fiber substrate containing the fibers 20 with the anionic absorbent resin 30. This small piece aggregate exhibits different absorption characteristics depending on electrolyte concentrations of liquids to be absorbed.

By using such a liquid absorbing material, for example, as the liquid absorber 10 of the liquid absorbing device 100, it is possible to cause liquids having different electrolyte concentrations to behave differently in response to differences in absorption characteristics. Consequently, the liquid absorbing device 100 that can detect a type of ink is easily and successfully realized by utilizing such behavioral differences.

Further, as in the foregoing, each of the small pieces 1 contained in the small piece aggregate has at least a first principal surface and a second principal surface facing a side opposite to the first principal surface and is in a plate shape having the principal surfaces exposed outside.

Since such a liquid absorbing material being a small piece aggregate can change the shape freely, it is possible, for example, to easily store a desirable amount of the liquid absorber 10 (liquid absorbing material) in the above-described storage section 92 and to easily adjust the bulk density. As a result, it is possible to prevent unevenness in absorption characteristics of ink Q from arising in the liquid absorber 10.

Next, the container 9 will be described. The container 9 includes the feed port 91, the storage section 92, the inflow section 93, and the communicating portion 94 as illustrated in FIGS. 1 and 2. In addition, the container 9 has a lid 8 detachably fitted to the upper opening 97.

The container 9 is a box having a bottom 901 and four side walls 902 standing on the bottom 901. The space surrounded by the bottom 901 and the four side walls 902 is divided into two portions of the storage section 92 and the inflow section 93 by an inner wall 903. The lid 8 has a through hole provided in the thickness direction, and this through hole constitutes the feed port 91 for supplying ink Q. The feed port 91 is provided at a position corresponding to the storage section 92.

The container 9 may have any shape when viewed from the perpendicular direction. Exemplary shapes include quadrilateral; polygons, such as hexagon; circular shapes, such as circle, ellipse, and oval; and irregular shapes.

The inner wall 903 has a through hole provided in the lower portion, and the through hole constitutes the communicating portion 94. In other words, the communicating portion 94 is provided between a lower portion in the vertical direction of the storage section 92 and a lower portion in the vertical direction of the inflow section 93. Through the communicating portion 94, the storage section 92 and the inflow section 93 are connected.

By providing the communicating portion 94 at such a position, excessive ink Q that has not been absorbed into the liquid absorber 10 in the storage section 92 can be guided to the communicating portion 94 in a shorter time and is allowed to flow further into the inflow section 93. Consequently, it is possible to promptly detect, at the detection unit 7 described hereinafter, whether ink Q is pigment ink or dye ink.

The lower portion in the vertical direction of the storage section 92 herein refers to a 20% or less portion from the lower end of the full length in the vertical direction of the storage section 92. In the same manner, the lower portion in the vertical direction of the inflow section 93 refers to a 20% or less portion from the lower end of the full length in the vertical direction of the inflow section 93. The communicating portion 94 may also be provided in an upper portion in addition to the lower portion of the inner wall 903.

The cross-sectional shape of the communicating portion 94, in other words, the cross-sectional shape when cut in a plane perpendicular to the thickness direction of the inner wall 903, is not particularly limited and may be circular, quadrilateral, or other shapes. However, from a viewpoint of preventing passing of the small pieces 1 of the liquid absorber 10 stored in the storage section 92 through the communicating portion 94, a circular shape is preferable. The communicating portion 94 may be constructed as a collection of fine through holes, such as a mesh structure or a slit structure.

The longest inner diameter on the cross-section of the communicating portion 94 is not particularly limited but is preferably 0.1 mm or more and less than the length of the shortest side on the principal surfaces of the small pieces 1. By setting the inner diameter of the communicating portion 94 as above, it is possible to satisfactorily lower the flow resistance in the communicating portion 94 while preventing the small pieces 1 included in the liquid absorber 10 from unintentionally entering the communicating portion 94. Consequently, it is possible to keep the inside of the inflow section 93 hollow without allowing entry of the small pieces 1 as well as to perform further accurate detection of a liquid surface at the detection unit 7.

The volume of the inflow section 93 is preferably smaller than the volume of the storage section 92. Specifically, a proportion of the volume of the inflow section 93 to the volume of the storage section 92 is preferably 0.01% or more and 10.0% or less and more preferably 0.05% or more and 8.0% or less. According to such proportions, it is possible to ensure a sufficiently large volume of the liquid absorber 10 to be stored in the storage section 92 as well as to increase a displacement range of the liquid surface of ink Q that has flown into the inflow section 93. Consequently, it is possible to realize the liquid absorbing device 100 that exhibits an increased amount of ink Q to be absorbed and excellent detection accuracy in displacement of a liquid surface at the detection unit 7.

The liquid absorber 10 is stored in the storage section 92 as described above. When the volume of the storage section 92 is denoted by V1 and the apparent volume of the liquid absorber 10 before absorbing ink Q is denoted by V2, a ratio of V2 to V1 (V2/V1) is preferably 0.1 or more and 0.7 or less and more preferably 0.2 or more and 0.7 or less. By setting as above, a void 96 is formed above the liquid absorber 10 within the storage section 92. After absorbing ink Q, the liquid absorber 10 temporarily swells. On this occasion, ink Q can be retained in this void 96 temporarily. For this reason, the void 96 acts as a buffer when the liquid absorber 10 absorbs ink Q. As a result, the liquid absorber 10 can sufficiently absorb ink Q.

The container 9 according to the present embodiment is hard, in other words, does not change 10% or more of the volume even when internal pressure or external force is exerted on the container 9. Accordingly, deformation can be suppressed even when internal pressure or external force is exerted on the container 9. As a result, the installation state of the container 9 stabilizes within the droplet discharge apparatus 200, and the liquid absorber 10 can absorb ink Q in a stable manner.

Component materials for the container 9 are not particularly limited unless the component materials allow permeation of ink Q. Exemplary component materials for the container 9 include various resin materials, such as cyclic polyolefins and polycarbonates. Moreover, other than the above-mentioned various resin materials, various metal materials, such as aluminum and stainless steel, can also be used as the component materials for the container 9.

The container 9 is not limited to a hard one and may also be flexible, in other words, may change 10% or more of the volume when internal pressure or external force is exerted on the container 9.

Moreover, the container 9 may be either transparent with visibility of the inside or opaque, but at least part of the container 9 and the lid 8 described hereinafter preferably has visibility of the inside.

Meanwhile, the lid 8 has a plate shape and is fitted into the upper opening 97 of the container 9 as illustrated in FIGS.

1 and 2. By such fitting, even when ink Q is discharged from the tube 203, dropped, and splashed on the liquid absorber 10, outward scattering of ink Q can be prevented. Accordingly, it is possible to prevent soiling through attachment of ink Q to the surroundings of the liquid absorbing device 100.

Even when the lid 8 is provided, ventilation of the storage section 92 and the inflow section 93 with the outside air is ensured. Consequently, it is possible to allow ink Q to flow smoothly from the storage section 92 into the inflow section 93.

Further, the lid 8 may be provided as necessary and may also be omitted. In such a case, the upper surface of the container 9 is exposed and a portion of the upper opening 97 corresponding to the storage section 92 constitutes the above-described feed port 91.

The tube 203 is coupled to the feed port 91 that is provided in the central part of the lid 8. In this configuration, an outlet 203*a* of the tube 203 faces downward in the vertical direction. Here, the feed port 91 may be shifted from the central part, and the outlet 203*a* of the tube 203 may face a direction other than downward in the vertical direction.

The lid 8 may exhibit absorption properties for absorbing ink Q or exhibit liquid repellency for repelling ink Q.

The thickness of the lid 8 is not particularly limited and is preferably 1 mm or more and 20 mm or less and more preferably 8 mm or more and 10 mm or less. Here, the lid 8 is not limited to a plate shape having the above-mentioned numerical ranges and may be a thinner film shape. In this case, the thickness of the lid 8 is not particularly limited and is 10 μm or more and less than 1 mm, for example.

Moreover, the lid 8 may exhibit water vapor permeability as necessary. By this property, moisture evaporated from absorbed ink Q is allowed to permeate outside. Consequently, it is possible to ensure a larger amount of ink Q to be absorbed by the liquid absorber 10.

In this case, the water vapor permeability of the lid 8 is preferably 1.0 $g/m^2$·day (40° C.·90% RH) or more and 5,000 $g/m^2$·day (40° C.·90% RH) or less and more preferably 2.0 $g/m^2$·day (40° C.·90% RH) or more and 2,000 $g/m^2$·day (40° C.·90% RH) or less. According to these ranges of the water vapor permeability, the above-mentioned effects can be exerted reliably.

Component materials for above-described container 9 and lid 8 are not particularly limited, and various resin materials, for example, may suitably be used. Exemplary resin materials include various thermoplastic resins and various curable resins, such as thermosetting resins and photocurable resins. Specific examples include polyolefins, such as polyethylene, polypropylene, and ethylene-propylene copolymer; polyvinyl chloride; polystyrene; polyamides; polyimides; polycarbonates; poly(4-methylpentene-1); ionomers; acrylic resins; poly(methyl methacrylate); acrylonitrile-butadiene-styrene copolymer (ABS resin); acrylonitrile-styrene copolymer (AS resin); butadiene-styrene copolymer; polyesters, such as poly(ethylene terephthalate) (PET) and poly(butylene terephthalate) (PBT); polyethers; polyether ketones (PEK); polyether ether ketones (PEEK); polyether imides; polyacetal (POM); polyphenylene oxide; polysulfones; polyether sulfones; polyphenylene sulfide; polyarylates; aromatic polyesters (liquid crystal polymers); polytetrafluoroethylene; polyvinylidene fluoride; other fluororesins; epoxy resins; phenolic resins; urea resins; melamine resins; silicone resins; polyurethanes; and copolymers, blends, and polymer alloys primarily containing these resins. These resins may be used alone or in combination.

The detection unit 7 is provided in the inflow section 93 of the container 9. As mentioned above, the detection unit 7 detects the presence of the liquid surface of ink Q that has flown into the inflow section 93. The detection method for the liquid surface by the detection unit 7 is not particularly limited, and examples include an electrically detecting method, an optically detecting method, a thermally detecting method, and a mechanically detecting method.

Among these methods, the detection unit 7 according to the present embodiment electrically detects ink Q, which is a liquid, and thus includes pairs of electrodes 711 and 712, an IC chip 72, and wiring 73 for electrically coupling the electrodes 711 and 712 to the IC chip 72. Specifically, a current value between the electrodes 711 and 712 or a resistance value between the electrodes 711 and 712 is measured at the IC chip 72. Since ink Q has higher electric conductivity than air, the IC chip 72 determines that ink Q is detected between the electrodes 711 and 712, for example, when the current value is equal to or more than a predetermined value or when the resistance value is less than a predetermined value. Meanwhile, the IC chip 72 determines that ink Q is not detected between the electrodes 711 and 712 when the current value is less than a predetermined value or when the resistance value is equal to or more than a predetermined value. In other words, the IC chip 72 has a function of measuring a current value or a resistance value and a function of determining whether ink Q is detected or not based on the measured results.

The IC chip 72 is electrically coupled to the above-mentioned control unit 206 of the droplet discharge apparatus 200 through wiring 208. The control unit 206 can presume that ink Q is dye ink when ink Q is detected at the detection unit 7 and that ink Q is pigment ink when ink Q is not detected.

According to the above-described electrical detection method, the type of ink Q can be detected further easily. In addition, due to the relatively simple configuration of the detection unit 7, there is also an advantage that the liquid absorbing device 100 is readily downsized.

The electrodes 711 and 712 illustrated in FIGS. 1 and 2 are each provided inside the inflow section 93. However, the electrodes 711 and 712 may partially constitute the side wall 902 provided that the electrodes 711 and 712 can come into contact with ink Q. Moreover, the electrodes 711 and 712 may be provided outside the side wall 902 and come into contact with ink Q via through holes of the side wall 902.

Further, the IC chip 72 illustrated in FIGS. 1 and 2 is provided outside the side wall 902 but may partially constitute the side wall 902.

The IC chip 72 is coupled to the above-mentioned control unit 206 through the wiring 208. However, between the contact of the IC chip 72 and the wiring 208 or between one wiring 208 and another wiring 208, for example, may be freely disconnected. By this configuration, the detection unit 7 and the control unit 206 can be electrically connected when the container 9 and the detection unit 7 attached to the container 9 are installed on the main body side of the droplet discharge apparatus 200. Meanwhile, the detection unit 7 can be insulated from the control unit 206 when the container 9 and the detection unit 7 are detached from the main body side of the droplet discharge apparatus 200. As a result, the liquid absorbing device 100 is exchangeable.

The IC chip 72 may be provided as necessary and may also be omitted. In such a case, the electrodes 711 and 712 are provided in the container 9, and the IC chip 72 may be provided on the main body side of the droplet discharge apparatus 200. Moreover, the IC chip 72 may be detached freely from the electrodes 711 and 712.

As mentioned above, exemplary detection methods for a liquid surface by the detection unit 7 include methods other than the electrically detecting method.

Among these methods, an optically detecting method will be described hereinafter. Meanwhile, exemplary thermally detecting methods include a method of detecting the presence or absence of ink Q by detecting temperature changes, for example. Further, exemplary mechanically detecting methods include a method that uses a float and detects the float being pushed up as a liquid surface rises and a method that uses a pressure gauge and detects an increase in pressure as a liquid surface rises.

It is possible to detect the inflow of ink Q into the inflow section 93 earlier as the position of the detection unit 7 is closer to the lower side in the inflow section 93. In contrast, it is possible to delay such detection as the position of the detection unit 7 is closer to the upper side in the inflow section 93. Accordingly, based on the above view, the position of the detection unit 7 in the inflow section 93 may be set appropriately.

For example, the position of the detection unit 7 in the inflow section 93 is preferably a 70% or less position, more preferably a 1% or more and 60% or less position, and further preferably a 5% or more and 50% or less position from the lower end in the full length in the vertical direction of the inflow section 93. By setting the position of the detection unit 7 within the above-mentioned ranges, it is possible to prevent extremely early detection of the liquid surface of ink Q as well as to detect a rise in liquid surface of ink Q before ink Q overflows. Consequently, a rise in liquid surface that arises when dye ink is used is selectively and readily detected without excessively detecting a rise in liquid surface that may also arise even when pigment ink is used. As a result, it is possible to detect, in the droplet discharge apparatus 200, the use of dye ink at a high probability while preventing needless issuing of warnings or termination of operation when pigment ink is used.

Meanwhile, the rising rate of the liquid surface of ink Q also varies depending on interactions between ink Q and the liquid absorber 10. Accordingly, the position of the detection unit 7 may be determined in advance through experiments or the like. For example, each of the above-mentioned low-concentration liquid and high-concentration liquid is supplied from the feed port 91 in an amount of 30% of the volume of the storage section 92 at a rate of 1 cc/h. The position of the detection unit 7 is determined, at the end of supplying, within a range higher than the height reached by the surface of the low-concentration liquid and equal to or lower than the height reached by the surface of the high-concentration liquid. As a result, it is possible to detect at a high probability a rise in liquid surface that arises when dye ink as an exemplary high-concentration liquid is used without detecting a rise in liquid surface that may also arise even when pigment ink as an exemplary low-concentration ink is used.

Figure 5:
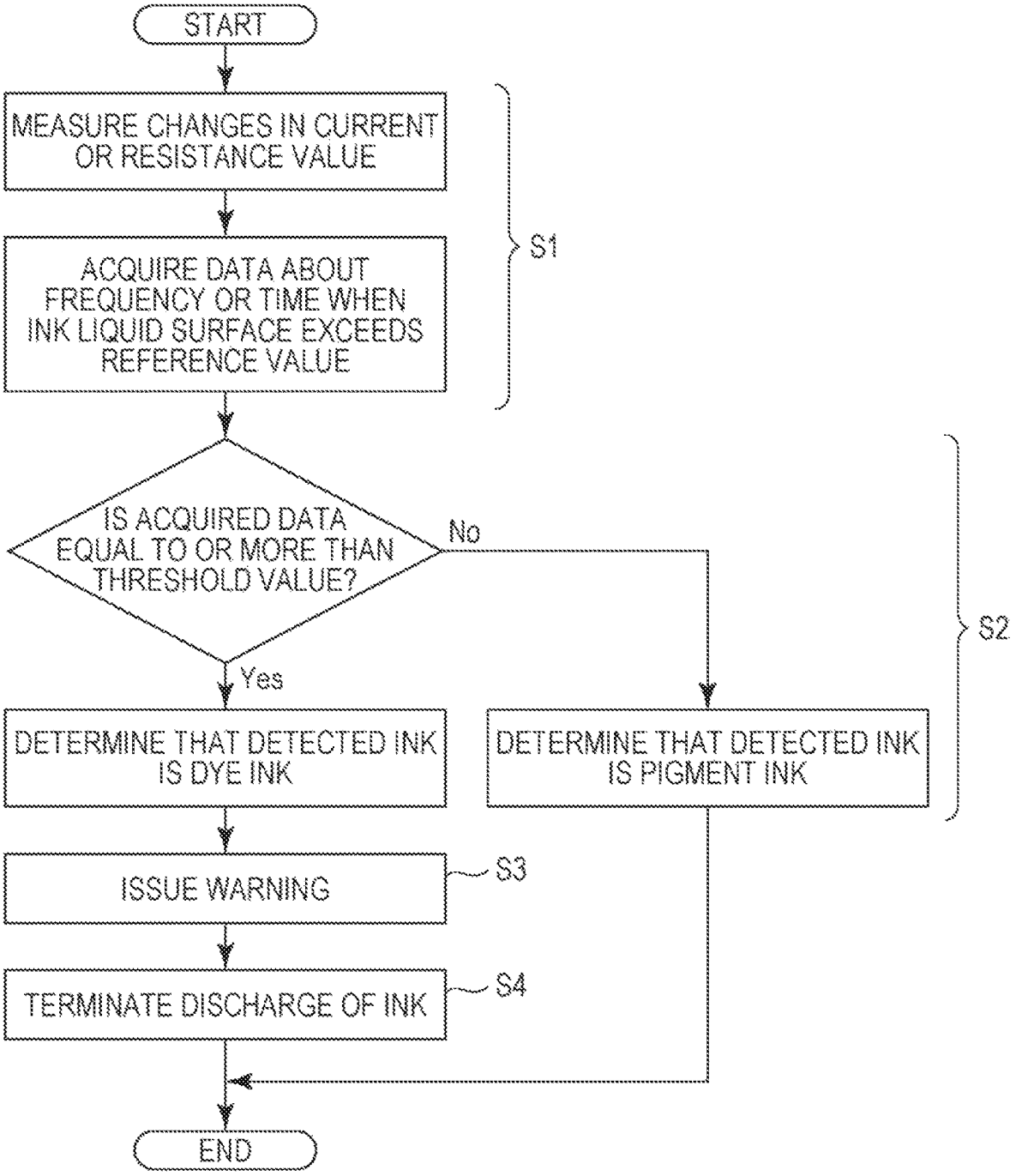
FIG. 5 is a flow chart showing a control method for the liquid absorbing device according to the first embodiment.

Next, a control method for the liquid absorbing device according to the first embodiment will be described. FIG. 5 is a flow chart showing the control method for the liquid absorbing device according to the first embodiment.

The control method for the liquid absorbing device 100 shown in FIG. 5 includes: step S1 of acquiring data about frequency or time when the surface height of ink Q, which is a liquid detected by the detection unit 7, exceeds a reference value; and step S2 of determining a type of ink Q based on the data. Hereinafter, each step will be described.

First, when ink Q is supplied from the feed port 91, ink Q flows into the inflow section 93 through the storage section 92 and the communicating portion 94. The detection unit 7 outputs changes in current value or resistance value obtained at the electrodes 711 and 712 to the IC chip 72. The IC chip 72 then records frequency or time when ink Q is detected based on the number of times or duration when the current value or resistance value changes. In other words, data about frequency or time when the liquid surface height of ink Q is considered to exceed a reference value is acquired. Such data is recorded, for example, as data about cumulative frequency or cumulative time from the start of using the liquid absorbing device 100.

Next, the IC chip 72 determines a type of ink Q based on the acquired data. Specifically, for example, the acquired data is compared with a threshold value stored in advance for cumulative frequency or cumulative time. When the acquired data is equal to or more than the threshold value, ink Q is determined to be dye ink. Meanwhile, when the acquired data is less than the threshold value, ink Q is determined to be pigment ink.

Here, the threshold value for frequency or time may be changeable afterwards. Moreover, data to be recorded at the IC chip 72 may be resettable.

According to the above-described control method for the liquid absorbing device 100, it is possible to easily detect what type of ink is used for liquids having different electrolyte concentrations, specifically pigment ink and dye ink, for example.

Subsequently, the determined results may be output to the control unit 206 of the droplet discharge apparatus 200 or may be stored at the IC chip 72. FIG. 5 also shows control details at the control unit 206 of the droplet discharge apparatus 200, in addition to the control method for the liquid absorbing device 100. In other words, FIG. 5 shows an example in which determined results are output to the control unit 206 and also utilized for the control of the droplet discharge apparatus 200.

When ink Q is determined to be dye ink, the control unit 206, as necessary, terminates the discharge of dye ink at the ink discharge head 201 and/or causes the notifying unit 207 to issue a warning about the use of dye ink. As a result, it is possible to prevent damage to the droplet discharge apparatus 200 and/or overflow of dye ink from the liquid absorbing device 100.

When ink Q is determined to be dye ink, a warning is first issued as the initial stage as in step S3 shown in FIG. 5. After that, when data indicating dye ink continue to be acquired even after the passage of a predetermined time, as the next stage, the discharge of ink Q at the ink discharge head 201 is terminated as in step S4 shown in FIG. 5. Through this stepwise procedure, the droplet discharge apparatus 200 may be controlled.

Here, the predetermined time may be time stored at the control unit 206 in advance or time changeable afterwards.

Second Embodiment

Figure 6:
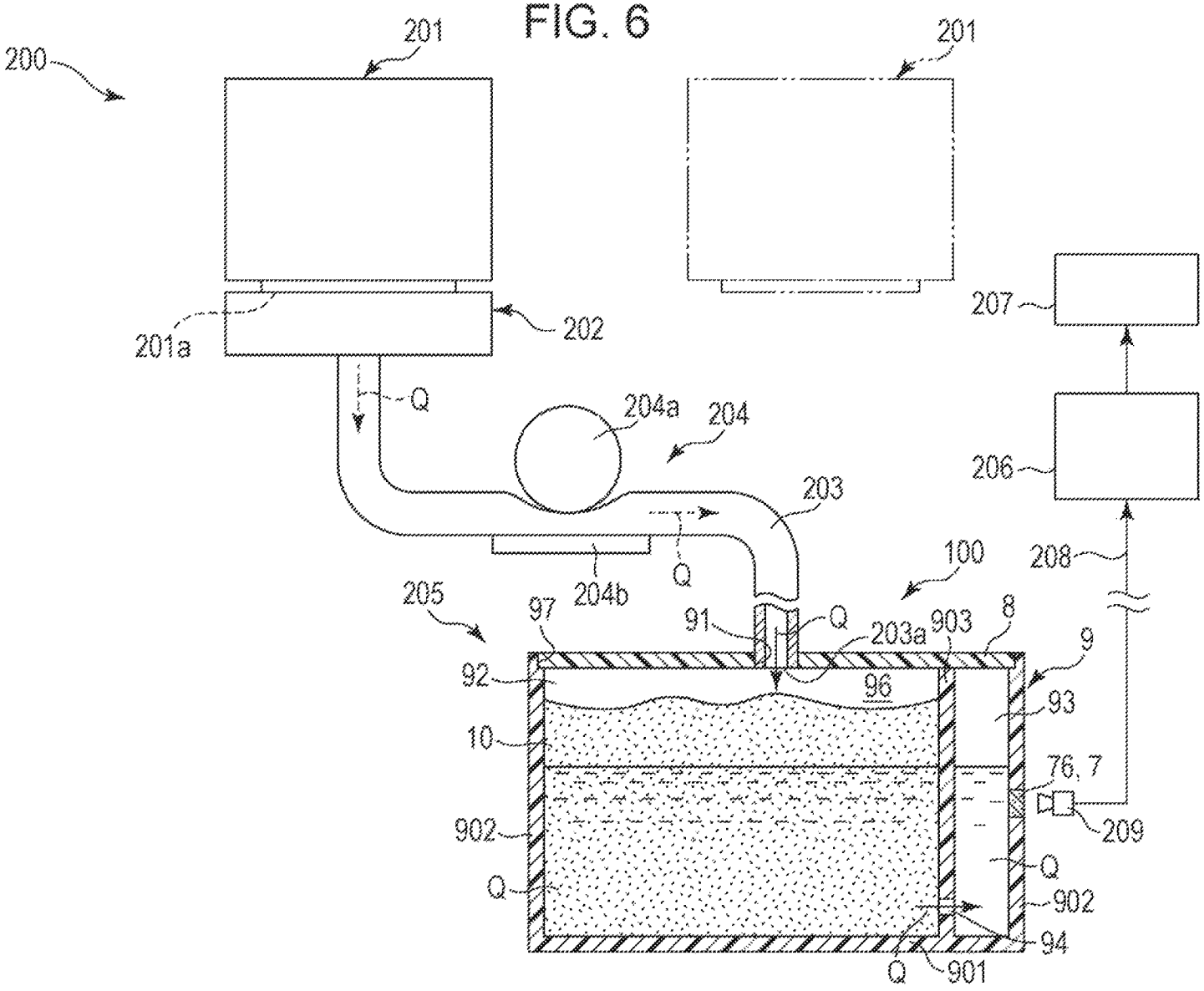
FIG. 6 is a partial vertical cross-sectional view illustrating a liquid absorbing device according to a second embodiment in use.

Next, a liquid absorbing device according to the second embodiment will be described. FIG. 6 is a partial vertical cross-sectional view illustrating the liquid absorbing device according to the second embodiment in use.

Hereinafter, the second embodiment will be described. In the following explanation, differences from the foregoing embodiment will be mainly described while omitting the explanation about similar matters. In FIG. 6, similar components to those in the foregoing embodiment are denoted by the same signs.

The second embodiment is the same as the first embodiment except for the configuration of the detection unit 7. The detection unit 7 according to the above-described first embodiment includes the electrodes 711 and 712 and the IC chip 72 whereas the detection unit 7 according to the present embodiment is provided in the side wall 902 and includes a window 76 for optically detecting the liquid surface of ink Q as an exemplary liquid. The window 76 is translucent and allows the liquid surface of ink Q that has flown into the inflow section 93 to be viewed from the outside of the container 9. According to such an optical detection method, the liquid absorbing device 100 can be easily downsized due to the relatively simple configuration of the detection unit 7. In addition, when the liquid surface is optically detected through the window 76, physical contact between a detection means and the window 76 is not needed. Accordingly, it is possible to easily perform detachment operation of the container 9 and the detection unit 7 attached to the container 9 from the main body side of the droplet discharge apparatus 200.

Here, the window 76 also acts as part of the side wall 902 and is provided such that liquid tightness is maintained between the window 76 and the side wall 902. As a result, leakage of ink Q from the inflow section 93 is prevented.

Moreover, the droplet discharge apparatus 200 illustrated in FIG. 6 includes a photoelectric sensor 209 provided at a position facing the window 76. The photoelectric sensor 209 optically detects the presence or absence of ink Q through the window 76 by irradiating the window 76 and measuring the quantity of reflected light. Specifically, when the photoelectric sensor 209 irradiates inside the inflow section 93 through the window 76 and if ink Q is present in the inflow section 93, light reflected by ink Q reaches the photoelectric sensor 209 through the window 76 again. Meanwhile, when ink Q is absent in the inflow section 93, light reflected by the inner wall of the inflow section 93 reaches the photoelectric sensor 209. On such an occasion, reflectance on a reflecting surface varies depending on the component materials and/or surface state of the reflecting surface. In other words, the quantity of reflected light varies depending on whether light is reflected by ink Q or reflected by the inner wall of the inflow section 93. Accordingly, it is possible to determine the presence or absence of ink Q by measuring and comparing the quantity of light received at the photoelectric sensor 209.

Further, other than the quantity of received light, the presence or absence of ink Q may be determined according to the color of a reflecting surface. Since ink Q is waste ink, it often shows a black color. Accordingly, the photoelectric sensor 209 may be configured to irradiate with three color light of red, blue, and green and measure the color of light reflected by ink Q, in other words, the colorimetric value. By designing the color of the inner wall of the inflow section 93 as a color other than black, a difference arises between the colorimetric value of light reflected by ink Q and the colorimetric value of light reflected by the inner wall of the inflow section 93. Consequently, it is also possible to determine the presence or absence of ink Q according to colorimetric values.

The photoelectric sensor 209 is electrically coupled to the control unit 206 as illustrated in FIG. 6. Accordingly, based on the results detected by the photoelectric sensor 209, the control unit 206 may be configured to terminate the discharge of dye ink at the ink discharge head 201 and/or cause the notifying unit 207 to issue a warning about the use of dye ink, for example.

In the present embodiment, the photoelectric sensor 209 is provided on the main body side of the droplet discharge apparatus 200 rather than in the liquid absorbing device 100. However, the photoelectric sensor 209 may be built in the liquid absorbing device 100. In such a case, an IC chip may be mounted together with the photoelectric sensor 209, and the liquid absorbing device 100 may be configured to perform a process of determining a type of ink Q and output the determined results.

The photoelectric sensor 209 illustrated in FIG. 6 is a so-called reflective sensor but may be a transmission sensor composed of a light transmitter and a light receiver. In this case, windows 76 may be each provided at two positions of the side wall 902 via the inflow section 93 of the container 9. The light transmitter may be set facing either of the windows 76 whereas the light receiver may be set facing the other window 76. By this configuration, it is possible to detect changes in quantity of light transmitting the inflow section 93. Consequently, the presence or absence of ink Q can be detected based on the quantity of received light or colorimetric values in a similar manner to the foregoing.

In place of the photoelectric sensor 209, an imaging sensor, a photodiode, and so forth may be used as well. In the second embodiment as described above as well, effects similar to the effects of the first embodiment can also be obtained.

Third Embodiment

Next, a liquid absorbing device according to the third embodiment will be described.

Figure 7:
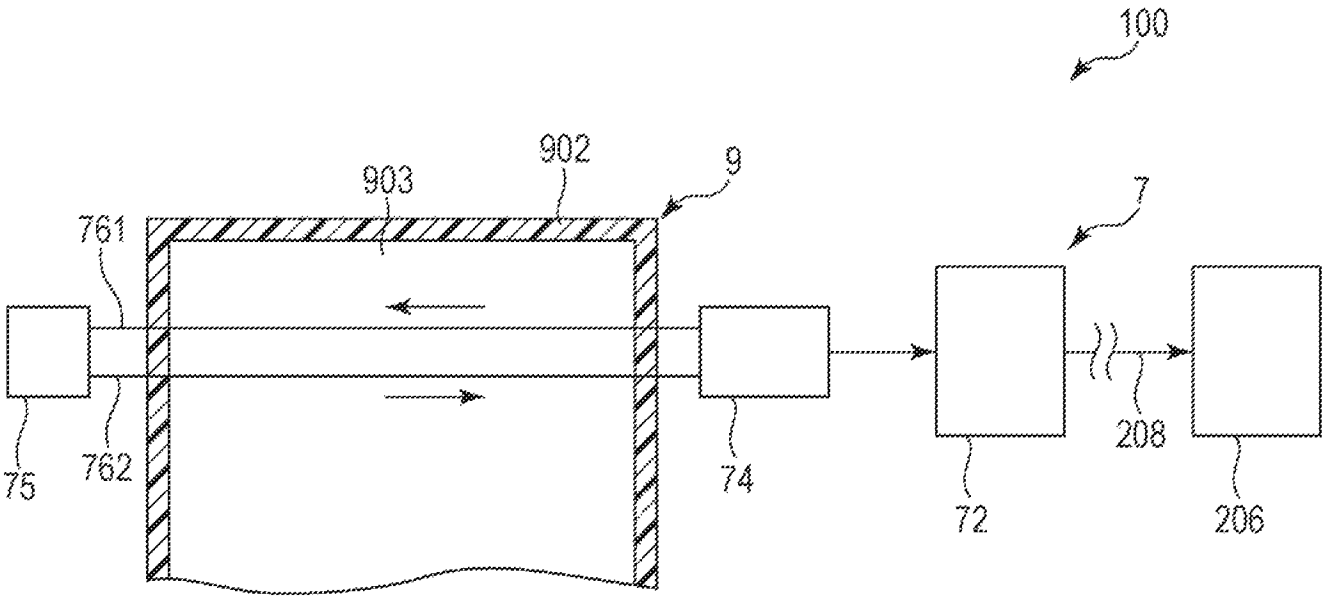
FIG. 7 is a conceptual diagram illustrating a liquid absorbing device according to a third embodiment.

FIG. 7 is a conceptual diagram illustrating the liquid absorbing device according to the third embodiment. Here, FIG. 7 is a diagram for illustrating the concept of the detection unit 7 and thus does not take account of the positional relationship between the container 9 and the detection unit 7 for convenience of explanation.

Hereinafter, the third embodiment will be described. In the following explanation, differences from the foregoing embodiments will be mainly described while omitting the explanation about similar matters. In FIG. 7, similar components to those in the foregoing embodiments are denoted by the same signs. The third embodiment is the same as the first embodiment except for the configuration of the detection unit 7.

The detection unit 7 illustrated in FIG. 7 includes an input/output unit 74, a terminal unit 75, two electric leads 761 and 762 for electrically coupling these units, and an IC chip 72.

The input/output unit 74 is coupled to each end of the two electric leads 761 and 762. From the output portion of the input/output unit 74, a pulse signal is output to the terminal unit 75 through one electric lead 761. When the pulse signal returns through the other electric lead 762, the signal is input to the input portion of the input/output unit 74. Moreover, the input/output unit 74 has a function of measuring the voltage of the pulse signal input to the input portion and comparing the voltage with a threshold value stored in advance. Here, the input/output unit 74 is provided outside the inflow section 93, for example.

Meanwhile, the terminal unit 75 is coupled to the other end of the two electric leads 761 and 762. A pulse signal input to one electric lead 761 attenuates at the terminal unit 75 and is not output to the other electric lead 762. In other words, the terminal unit 75 has a function of shielding a pulse signal. Here, the terminal unit 75 is provided outside the inflow section 93, for example, but may be provided inside the inflow section 93.

Both of the two electric leads 761 and 762 are placed, for example, to penetrate the side wall 902, pass through the inside of the inflow section 93, and penetrate the side wall 902 again. At least part of the two electric leads 761 and 762 that are positioned inside the inflow section 93 lack sheaths and the like. Accordingly, when ink Q that has flown into the inflow section 93 simultaneously comes into contact with both of the two electric leads 761 and 762, the electric leads 761 and 762 are designed to short-circuit. Meanwhile, the electric leads 761 and 762 are set apart from each other and are designed not to short-circuit when ink Q does not come into contact with the electric leads simultaneously.

In the above-described detection unit 7, when ink Q does not reach the height of the detection unit 7, in other words, when ink Q does not come into contact with the two electric leads 761 and 762, the electric leads 761 and 762 do not short-circuit. As a result, a pulse signal output from the input/output unit 74 is shielded at the terminal unit 75 and does not return to the input/output unit 74.

Meanwhile, when ink Q reaches the height of the detection unit 7, in other words, when ink Q comes into contact with the two electric leads 761 and 762, the electric leads 761 and 762 short-circuit. As a result, a pulse signal output from the input/output unit 74 returns to the input/output unit 74 through the short-circuited portion due to ink Q.

Through this procedure, it is possible to detect the presence of ink Q based on the presence or absence of a pulse signal that returns to the input/output unit 74 and further, to presume a type of ink Q. In the above-described third embodiment as well, effects similar to the effects of the foregoing embodiments can also be obtained.

The detection unit 7 illustrated in FIG. 7 may further have a function of detecting the disconnection of the electric leads 761 and 762. A pulse signal also does not return to the input/output unit 74 when at least either of the two electric leads 761 and 762 is disconnected. Accordingly, there is a problem in which it is impossible to determine, solely from the result of a received pulse signal, whether ink Q is not detected or the disconnection occurs.

By imparting a function of detecting the disconnection of the electric leads 761 and 762 to the detection unit 7 illustrated in FIG. 7, it is possible to enhance the reliability of the liquid absorbing device 100. Specifically, the detection unit 7 illustrated in FIG. 7 has a function of regularly setting a period of time without outputting a pulse signal while outputting a direct-current signal in this period of time. Meanwhile, the terminal unit 75 has a function of passing through a direct-current signal while shielding a pulse signal as described above.

As a result, when both of the two electric leads 761 and 762 are normal, in other words, when neither of the electric lead 761 or 762 is disconnected, a direct-current signal output from the input/output unit 74 returns to the input/output unit 74 via the terminal unit 75.

Meanwhile, either of the two electric leads 761 and 762 is disconnected, a direct-current signal output from the input/output unit 74 is interrupted at the disconnected portion and does not return to the input/output unit 74.

As described above, the disconnection of the electric leads 761 and 762 can be detected based on whether a direct-current signal returns to the input/output unit 74. As a result, it is possible to enhance the reliability of the liquid absorbing device 100.

The result of the detected disconnection may also be output to the control unit 206 of the droplet discharge apparatus 200, as necessary, or may be stored at the IC chip 72. The control unit 206, as necessary, terminates the discharge of ink Q at the ink discharge head 201 and/or causes the notifying unit 207 to issue a warning about the disconnection of the electric leads 761 and 762.

Fourth Embodiment

Figure 8:
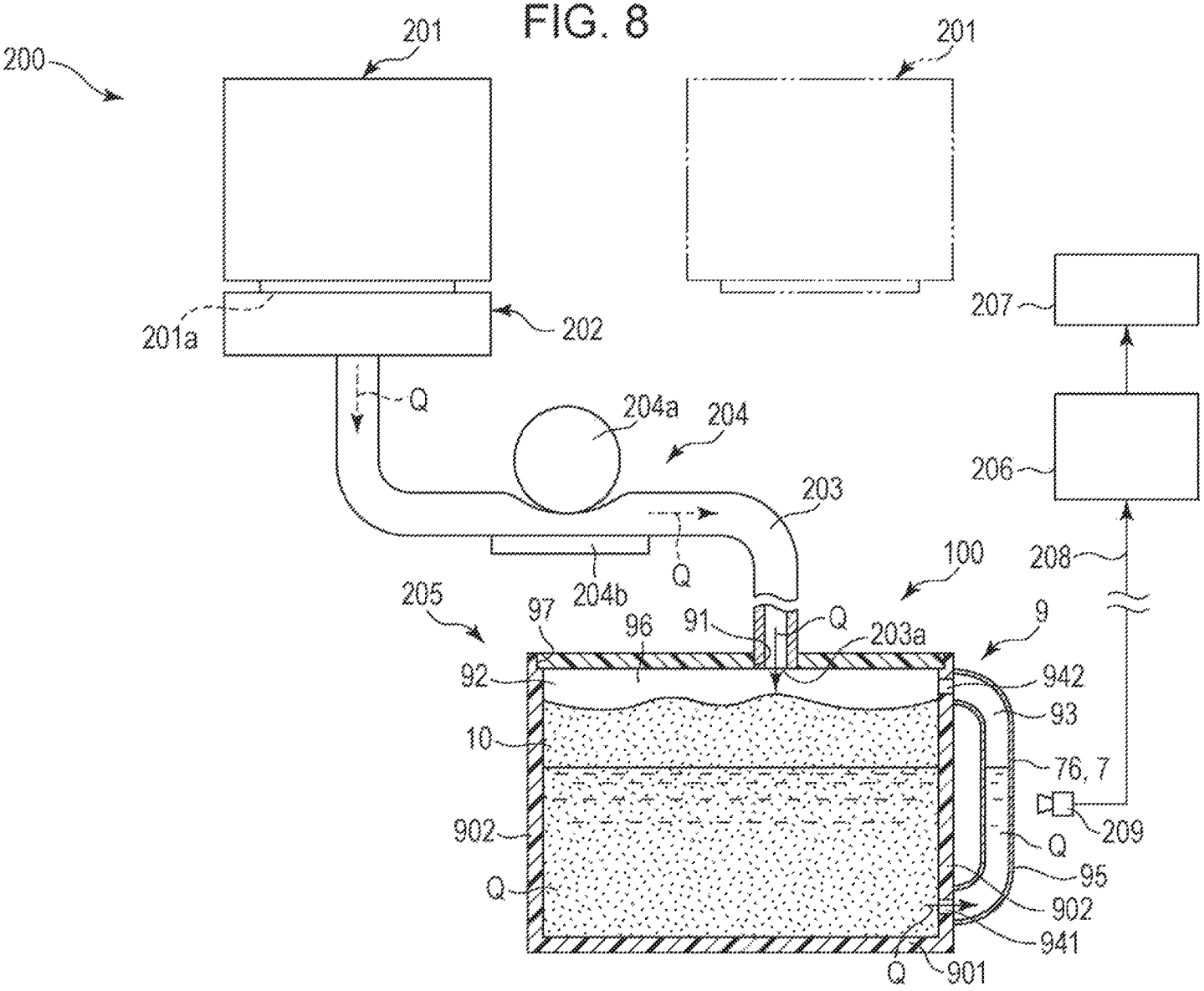
FIG. 8 is a partial vertical cross-sectional view illustrating a liquid absorbing device according to a fourth embodiment in use.

Next, a liquid absorbing device according to the fourth embodiment will be described. FIG. 8 is a partial vertical cross-sectional view illustrating the liquid absorbing device according to the fourth embodiment in use.

Hereinafter, the fourth embodiment will be described. In the following explanation, differences from the foregoing embodiments will be mainly described while omitting the explanation about similar matters. In FIG. 8, similar components to those in the foregoing embodiments are denoted by the same signs. The fourth embodiment is the same as the second embodiment except for the configuration of the container 9.

The container 9 illustrated in FIG. 8 includes a pipe 95 provided outside the side wall 902 instead of omitting the inner wall 903. Moreover, the side wall 902 has through holes provided on both the lower side and the upper side. The through hole on the lower side constitutes a communicating portion 941 that connects the storage section 92 with the pipe 95 whereas the through hole on the upper side constitutes a communicating portion 942 that connects the storage section 92 with the pipe 95. In other words, one end of the pipe 95 is coupled to the communicating portion 941 and the other end is coupled to the communicating portion 942. Accordingly, the inner space of the pipe 95 has the same function as the above-described inflow section 93.

Further, the pipe 95 is translucent. Accordingly, the pipe 95 allows the liquid surface of ink Q that has flown into the pipe 95 to be viewed from the outside of the container 9. Consequently, the pipe 95 as a whole constitutes the above-described window 76. Here, the pipe 95 may be only partially translucent, and the remainder need not be translucent. In such a case, the translucent part constitutes the window 76. In the above-described fourth embodiment as well, effects similar to the effects of the foregoing embodiments can also be obtained.

In the forgoing, the liquid absorbing device, the control method for the liquid absorbing device, and liquid absorbing material of the present disclosure are described based on the embodiments illustrated in the figures. The present disclosure, however, is not limited to these embodiments. For example, exemplary liquids having different electrolyte concentrations include pigment ink and dye ink in the above-described embodiments, and these embodiments have a function capable of detecting which ink is supplied. However, such liquids having different electrolyte concentrations are not limited to these inks and may be other liquids. Moreover, the configuration of each unit in the liquid absorbing device may be substituted with any configuration having the same function. Further, any other component may be added to the present disclosure. Still further, the embodiments may be appropriately combined with each other.

What is claimed is:

1. A liquid absorbing device comprising:

a liquid absorber including fibers and an absorbent resin designed to absorb a liquid wherein the liquid absorber is a small piece aggregate composed of a plurality of small pieces which are each formed by impregnating a fiber substrate containing the fibers with an anionic absorbent resin, and each of the small pieces is in a plate shape having two principal surfaces mutually in a front and rear relationship;

a container comprising:

a feed port to which the liquid is supplied, a storage section that is connected with the feed port and that stores the liquid absorber, an inflow section configured such that part of the liquid flows into the inflow section when the liquid is supplied to the storage section, and a communicating portion that connects the storage section with the inflow section; and a detection unit that is provided in the inflow section and that is configured to detect a surface of the liquid in the inflow section.

2. The liquid absorbing device according to claim 1, wherein the communicating portion is provided between a lower portion in the vertical direction of the storage section and a lower portion in the vertical direction of the inflow section.

3. The liquid absorbing device according to claim 1, wherein the detection unit includes an electrode for electrically detecting the surface of the liquid.

4. The liquid absorbing device according to claim 1, wherein the detection unit includes a window for optically detecting the surface of the liquid.

5. The liquid absorbing device according to claim 1, wherein the small pieces satisfy the following three requirements A, B, and C:

A: when the liquid is a low-concentration liquid having an electrolyte concentration of less than 1% by mass at 25° C., a ratio of a mass of the low-concentration liquid absorbed into the anionic absorbent resin to a mass of the anionic absorbent resin is 20 or more and 600 or less, B: when the liquid is a high-concentration liquid having an electrolyte concentration of 1% by mass or more at 25° C., a ratio of a mass of the high-concentration liquid absorbed into the anionic absorbent resin to the mass of the anionic absorbent resin is 10 or more and less than 20, and C: each of the small pieces satisfies relationships of $a^{1/2}/b>5$ and $0.01 \leq b \leq 10.00$ wherein a is an area of one of the two principal surfaces and b is a thickness in a normal direction to the principal surfaces.

6. The liquid absorbing device according to claim 1, wherein a longest inner diameter on a cross-section of the communicating portion is 0.1 mm or more and less than a length of a shortest side on the principal surfaces of the small pieces.

7. The liquid absorbing device according to claim 1, wherein the fibers are cellulose fibers.

8. The liquid absorbing device according to claim 1, wherein a proportion of a volume of the inflow section to a volume of the storage section is 0.01% or more and 10.0% or less.

* * * * *